United States Patent [19]

Cartwright et al.

[11] 4,243,053

[45] Jan. 6, 1981

[54] FILTER CIGAR

[75] Inventors: William F. Cartwright, Manchester; Alan Cornell, Bloomfield, both of Conn.; D. Bernard Higgins, Berwick, Pa.; Robert P. Mikkelson, East Hartford, Conn.

[73] Assignee: Gulf & Western Company, New York, N.Y.

[21] Appl. No.: 9,612

[22] Filed: Feb. 5, 1979

[51] Int. Cl.[3] ..... A24D 1/10

[52] U.S. Cl. ..... 131/4 A; 131/10 R; 131/15 A

[58] Field of Search ..... 131/10, 4 R, 4 A, 8 R, 131/8 A, 9, 11 R, 12, 15 R, 15 A, 76, 268

[56] References Cited

U.S. PATENT DOCUMENTS

| | | | |
|---|---|---|---|
| 2,167,170 | 7/1939 | Burns | 131/76 X |
| 2,189,032 | 6/1965 | Brothers | 131/76 X |
| 2,794,239 | 6/1957 | Crawford et al. | 131/268 |
| 3,653,390 | 4/1972 | Louden | 131/11 |

FOREIGN PATENT DOCUMENTS

| | | | |
|---|---|---|---|
| 1436073 | 5/1976 | United Kingdom | 131/4 A |

*Primary Examiner*—Stephen C. Pellegrino
*Attorney, Agent, or Firm*—Gregory J. Battersby

[57] ABSTRACT

A filter cigar is provided having outer layers of cigar wrapper and binder material each spirally wrapped about a preformed cigar filter and tobacco filler charge. A reinforcement strip including layers of high wet strength reinforcing tape and bonded to the binder is circumferentially wrapped over the interface between the filter and the filler charge.

4 Claims, 10 Drawing Figures

FILTER CIGAR

RELATED APPLICATION

Cross reference is made to concurrently filed U.S. patent application Ser. No. 009611, filed on Feb. 5, 1979, in the name of D. Bernard Higgins and Frederick D. Godfrey Jr. entitled "Method and Apparatus for Manufacturing Filter Cigar."

BACKGROUND OF THE INVENTION

This invention relates generally to a filter cigar and, more particularly, to a filtered large cigar having a circumferentially shaped preformed filter mated tightly with a tobacco filler charge, this union being reinforced by circumferentially wrapping reinforcement strip including layers of reinforcing tape and foil for extinguishing the cigar's flame prior to ignition of the filter over the interface between the filter and filler charge.

Filter cigarettes and cigars have been marketed in the tobacco industry for a number of years, however, attempts to incorporate such filters under the outer cigar wrapper have generally been limited to cigarettes and small cigars, i.e., cigars less than about 8 mm in diameter and less than about 110 mm in length. Filters have been used in conjunction with small and medium cigars by the incorporation of filters in thick mouth-pieces or plastic tips attached to one end of such cigars. Large cigars, i.e., cigars having a diameter of at least about 12 mm and a length of at least about 117 mm, due to their substantially larger size, are not readily adaptable for use in conjunction with such tips. The public acceptance of filtered cigarettes and smaller cigars has generated renewed interest in the incorporation of a filter on a large cigar and have lead to this invention.

Attempts in the past to incorporate a filter under the binder and wrapper of large cigars have proven commercially unsuccessful, principally because the physical bulk of such large cigars does not readily lend itself to use with a filter and often results in a separation between the filter and filler charge during use. Another concern has been ignition of the filter. Additionally, such attempts have generally produced a cigar which departed from the typical appearance of a large cigar and thus failed to attract a commercial following.

An example of such a prior art attempt to manufacture a filter cigar is described in U.S. Pat. No. 2,250,381 which issued to M. S. Kayner on July 22, 1941 wherein filtering material was incorporated within the filler charge under the binder with an air space provided between the filter and the filter. The obvious disadvantage of such a cigar is that this air space substantially increased the possibility of the filter separating from the filler charge during use. U.S. Pat. No. 1,477,993 which issued to C. F. Bremer on Dec. 18, 1923 described a filter cigar wherein a filter mouthpiece was secured to the filler charge by a pin, all of which were then surrounded by a binder.

Preformed filters incorporated in the bunch of cigars were described in U.S. Pat. Nos. 972,428 which issued to F. Acker on Oct. 11, 1910 and 899,355 which issued to J. O. Therien on Sept. 22, 1908. In neither of these patents were means taught for reinforcing the filter and filler charge to prevent a potential separation of the two during use. Also Henri Wintermann of Holland has also marketed a small filter cigar under the Trademark "Cafe' Filtre" which too lacks the reinforcement strip of the present invention.

Other approaches to overcome this potential separation problem include the incorporation of a spirally wound filter in the cigar bunch rather than using a preformed filter. See, for example, U.S. Pat. Nos. 642,000 which issued to F. C. Reed on Jan. 23, 1900; and 3,165,106 which issued to C. E. Schon on Jan. 12, 1965. U.S. Pat. No. 3,487,839, which issued to N. R. Parlatore on Jan. 6, 1970, discloses apparatus for wrapping a tobacco band over the point of intersection between a plastic filter tip and the tobacco filler charge under the wrapper.

Heretofore, applicants are aware of no attempts to reinforce either a preformed or spirally wound filter and tobacco filler charge to prevent separation between the filter and the filler charge during eventual use, nor are applicants aware of any attempts to incorporate flame extinguishing means in such a reinforcement strip. The use of a metallic band on the exterior of a cigarette to render a cigarette "magnetic" was, however, taught in U.S. Pat. No. 2,192,569 which issued to H. S. Williams on Mar. 5, 1940.

Against the foregoing background it is a primary objective of the present invention to provide a filtered large cigar wherein a preformed filter and tobacco filler charge are butted tightly together and reinforced to provide the same outward appearance as a conventional non-filtered large cigar.

It is another object of the present invention to provide a filtered large cigar having a preformed filter and tobacco filler charge the union of which are reinforced by reinforcing means bonded to the binder and circumferentially wrapped over the interface between the filter and filler charge.

It is still another object of the present invention to provide a filtered large cigar further including flame extinguishing means incorporated in said reinforcing means.

It is a further object of the present invention to provide an economic and commercially acceptable filtered large cigar having the same outward appearance as nonfiltered large cigars.

It is still a further object of the present invention to provide a commercially acceptable filtered large cigar having a similar taste and texture as other large cigars.

SUMMARY OF THE INVENTION

To the accomplishments to the foregoing objects and advantages, the present invention, in brief summary, comprises a filtered large cigar having an outer cigar wrapper and an inner cigar binder both spirally wrapped about a circumferentially shaped preformed filter butted tightly against a tobacco filler charge. A reinforcement strip, bonded to the binder, includes a layer of high wet strength reinforcing tape bonded to flame extinguishing foil and is circumferentially wrapped over the interface between the filter and the filler charge to prevent separation of the filter and the filler charge and to extinguish the flame prior to ignition of the filter.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DESCRIPTION OF THE PREFERRED EMBODIMENTS

Figure 1:
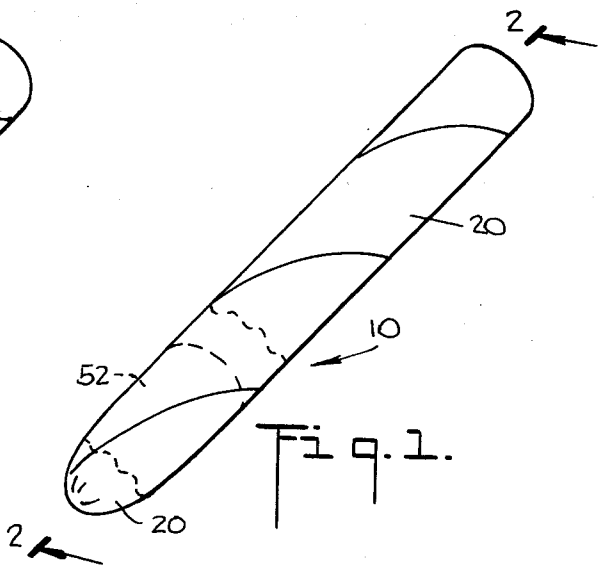
FIG. 1 illustrates the unwrapped but crimped filtered large cigar of the present invention wherein the reinforcement strip is circumferentially wrapped over the point of intersection between the filter and filler charge but under the binder.

The filtered large cigar of the present invention, shown unwrapped in FIG. 1 and referred to generally by reference numeral 10, may be manufactured in a variety of ways including, for example, by the use of hand rolling techniques. Other methods of manufacture which may be used include, but are not limited to, the method illustrated in FIGS. 5–7 which is discussed in substantially greater detail in concurrently filed patent application entitled "Method and Apparatus for Manufacturing Filter Cigar," Ser. No. 00961, filed on Feb. 5, 1979, in the names of D. Bernard Higgins and Frederick D. Godfrey, Jr. The subject matter of this concurrently filed patent application is expressly incorporated herein by reference thereto.

Figure 2:
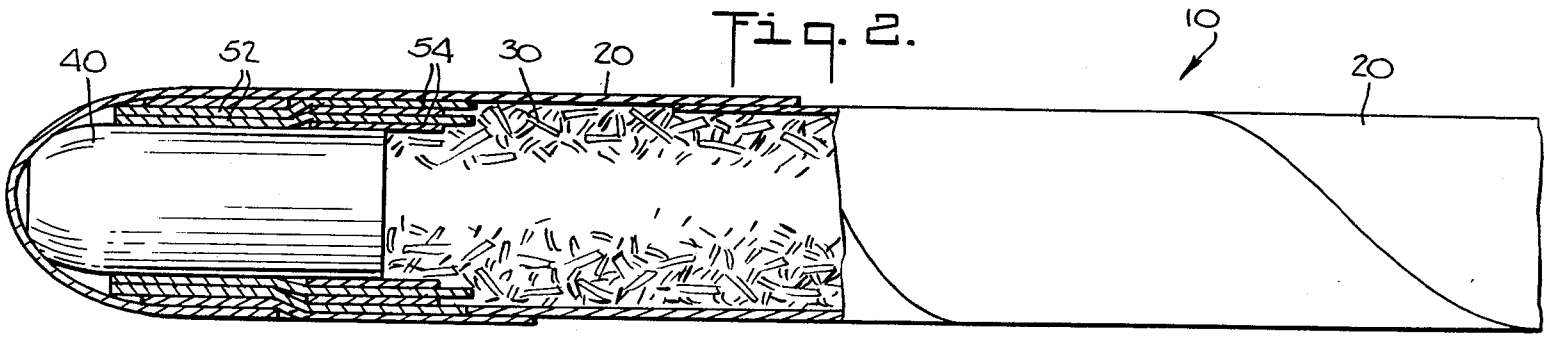
FIG. 2 is an exploded sectional view taken along line 2—2 of FIG 1.

Referring now to FIGS. 1 and 2, the bunch of the filtered large cigar 10 of the present invention includes a conventional tobacco filler charge 30 and a preformed cylindrical filter 40 which are spirally wrapped in a pre-cut sheet of conventional cigar binder material 20.

The tobacco filler charge 30 may be virtually any conventional large cigar tobacco filler charge and preferably consists principally of tobacco and tobacco blends. The tobacco filler charge 30 may be treated and additives added to enhance its burn, taste and aroma properties. Additionally, additives may be added to the tobacco filler material to enhance its taste and aroma characteristics.

Cylindrically shaped preformed filter 40 may be formed from virtually any smoke-absorbing medium although a preformed cellulose acetate filter is preferred. A particularly preferred cellulose acetate filter is marketed by the American Filtrona Company of Richmond, Virginia under the trademark Transorb which, heretofore, had only been used in conjunction with writing implements and not in tobacco or other food grade products. The size and shape of preformed cylindrical filter 40 is generally complimentary to the size and shape of tobacco filler charge 30 and is in proportion thereto. Preferably the diameters of the filter 40 and filler charge 30 are substantially equal and the length of the filter 40 should be between about 20% and about 40% of the length of tobacco filler charge 30. Preformed filters 40 having diameters of between about 11 mm and about 16 mm and lengths of between about 25 mm and about 45 mm have been found to give good results in the large cigars of the present invention.

The cigar binder material 20 spirally wrapped about the filler charge 30 and the filter 40, may be virtually any conventional binder material used in manufacturing large cigars. Binder 20 may be either natural, for example, a broad leaf tobacco or sheet consisting substantially of tobacco or it may be manufactured, approximately two-thirds of which is tobacco, the balance being conventional filler materials which include, for example, gums, inorganic ingredients, cellulose and wood pulp. In certain specific products, the tobacco content of binder 20 may be varied to produce a product with particular burn, taste and aroma properties.

To prevent separation between the filter 40 and the filler charge 30, a reinforcement strip 50 consisting of reinforcing tape 52 and a strip of an nonflammable material, preferably foil 54 is circumfrentially wrapped about the interface between the filter 40 and the tobacco filler charge 30 and bonded to the binder 20. Reinforcement strip 50 may be placed either over or under the binder 20. FIGS. 5–8 illustrate schematically the manner in which a cigar 10 having the reinforcing strip 50 wrapped under the binder 20 is manufactured, and the resultant unwrapped cigar 10 is shown in FIGS. 1 and 2. The reinforcement strip 50 in this embodiment is virtually invisible from outside detection as it is covered over by both the binder 20 and outer wrapper.

Figure 9:
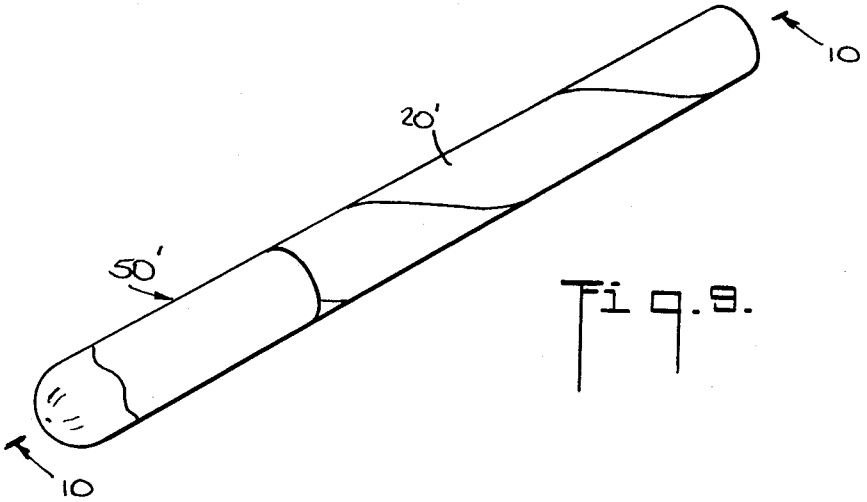
FIG. 9 illustrates another embodiment of the unwrapped but crimped filtered large cigar of the present invention wherein the reinforcement strip is wrapped over the binder.
Figure 10:
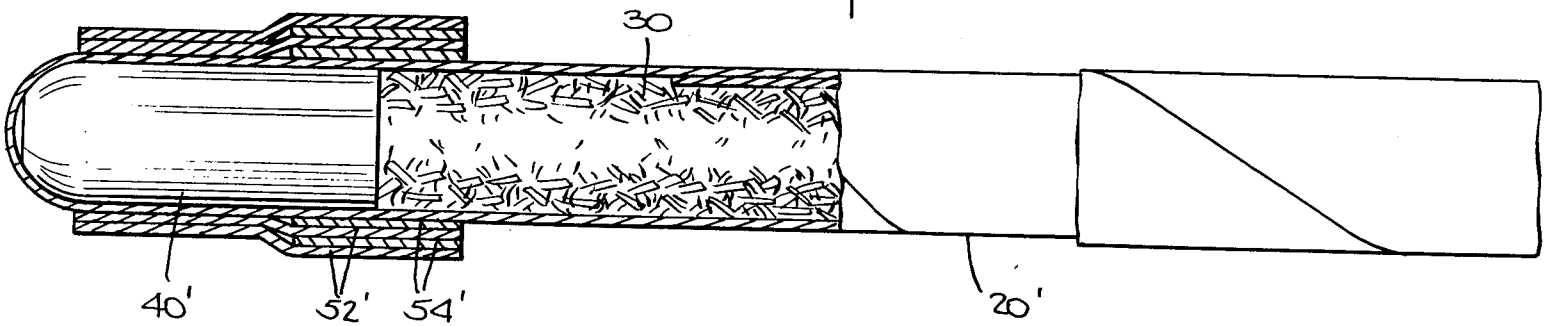
FIG. 10 is a sectional view taken along line 10—10 of FIG. 9.

Similarly, FIGS. 9 and 10 illustrate an unwrapped cigar 10′ wherein the reinforcement strip 50′, including layers of reinforcing tape 52′ and foil 54′, is circumferentially wrapped over and bonded to the binder 20′ over the interface between the filter 40′ and filler charge 30′.

Reinforcing tape 52, preferably a non-tobacco product, has a wet strength higher than the wet strength of either the tobacco-containing binder 20 or the outer cigar wrapper which may be either a leaf of natural tobacco or a sheet of manufactured tobacco material. Preferably, reinforcing tape 52 is a paper product and, most preferably, is manufactured from virgin paper pulp, and may, if desired, include other non-toxic materials. The wet strength of the reinforcing tape 52, when measured in one-quarter inch strips, should be at least about 550 grams in the longitudinal direction and preferably between about 600 and about 800 grams. Similarly, the wet strength of the reinforcing tape 52, when measured in one-quarter inch strips, should be at least about 100 grams in the transverse direction and preferably between about 110 grams and about 200 grams. It has been found that when the longitudinal wet strength of reinforcing tape 52 is at least 550 grams and the transverse wet strength is at least 100 grams, it is resistant to disintegration by the smoker's saliva during use, particularly if masticated. A particularly preferred type of reinforcing tape 52 is the lightweight virgin pulp tape marketed by Tinnicon Research Company of Frenchtown, N.J. under the trademark Tinnicon E-140. Reinforcing tape 52 may also, if desired, be a combination of paper and parchment provided it meets the above stated wet strength requirements.

Reinforcing tape 52 is preferrably corrugated on both edges for both ease of installation and to minimize the possibility of tearing during installation and use. Reinforcing tape 52 must also be sufficiently thin for ease of manufacture and application and to prevent any noticeable bulge under the cigar wrapper. In this regard, it is preferred that the thickness of reinforcing tape 52 be between about 0.001 and about 0.002 inches.

Figure 3:
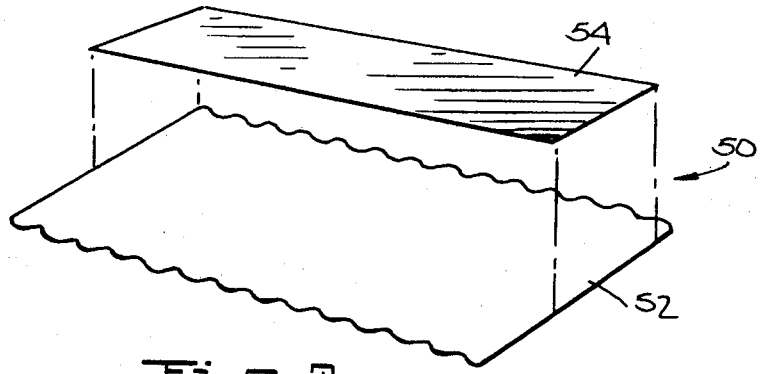
FIG. 3 is an exploded perspective view of the reinforcement strip of the present invention.
Figure 4:
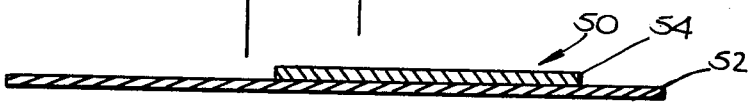
FIG. 4 is a sectional view of the reinforcement strip shown in FIG. 3.

As shown in greater detail in FIGS. 3 and 4, reinforcement strip 50 also includes a strip of nonflammable flame extinguishing material, preferably foil 54, adhesively bonded to reinforcing tape 52 and extending substantially along the entire longitudinal extent of reinforcing tape 52 although occupying less than one half of its width. Nonflammable strip 54 may be of virtually any material sufficiently impermeable to the diffusion of air to quench the burning cigar coal, and, as previously stated, is preferably a metallic foil and, most preferably, aluminum foil. In a preferred embodiment, a strip of foil 54, between approximately 0.00025 and 0.00075 inches in thickness, is bonded to reinforcing tape 52 to form reinforcement strip 50, and in a most preferred embodiment, a strip of aluminum foil, approximately 0.0005 inches in thickness is bonded to the reinforcing tape 52 to form the reinforcement strip 50. Foil 54 is bonded to reinforcing tape 52 in such a position that when reinforcement strip 50 is circumferentially wrapped about the filter 40 and filler charge 30, whether over or under the binder 20, the foil 54 will be positioned directly over the interface between the filter 40 and the tobacco filler charge 30, so as to extinguish the flame of the cigar prior to ignition of the filter 40.

Foil 54 is adhesively bonded to reinforcing tape 52 using any adhesive suitable for bonding wood or paper products to metallic objects. Preferred adhesives for effecting this bond include food grade polyvinyl acetate emulsions or emulsion type adhesives. A particularly preferred polyvinyl acetate emulsion is marketed by Peter Cooper Corporations of Gowanda, New York under the trade designation PVE-1009. Peter Cooper PVE-1009 is a food grade polyvinyl acetate emulsion which is plasticized with butyl benzyl phthallate and which includes less than 1% of a colloid defoamer and sodium benzoate.

Reinforcement strip 50 may be circumfentially wrapped either over the binder 20, as shown in FIGS. 9–10, or under the binder 20 as shown in FIGS. 1–8.

In the embodiment of FIGS. 1–8, wherein the reinforcement strip 50 is located under the binder 20, the reinforcement strip 50 is preferrably double wrapped about the filter 40 and filler charge 30 to create two layers of reinforcement. Thus, as shown in the cross-section of FIG. 2, reinforcement strip 50 includes at least two alternating layers each of reinforcing tape 52 and foil 54 with the foil 54 being the inside layer directly contacting the filter 40 and filler charge 30 and with the reinforcing tape 52 being the outside layer bonded to the binder 20. In this manner, the foil 54 is tightly wrapped about the filler 30 and filter 40 for maximum flame extinguishment and is concealed by the reinforcing tape 52 which has a more natural appearance should the wrapper disintegrate or tear.

In the alternative embodiment of FIGS. 9–10 wherein the reinforcement strip 50' is positioned over and bonded to the binder 20', the reinforcement strip 50' is also preferably double wound to form two layers and it is also positioned such that the inside layer is foil 54' directly contacting the binder 20' and positioned directly over the point of intersection between the filter 40 and filler charge 30 with the reinforcing tape 52' being the outermost layer. As the reinforcing tape 52' is wider than the foil 54', a bond is still effected between the reinforcing tape 52' and the binder 20'.

Reinforcement strip 50, in both embodiments, is adhesively bonded to the binder 20 by the use of any conventional adhesive for bonding paper to tobacco, preferably, a methyl cellulose based adhesive such as, for example, the methyl cellulose adhesive marketed by Dow Chemical under the trademark Methocel. Other suitable adhesives for effecting such a bond include naturally occuring gums such as gum tragacanth and mixtures of cellulose gums, carboxy methyl cellulose, synthetic gums and protein colloids. By bonding the reinforcement strip 50 to the binder 20, reinforcement strip 50 will not shift relative to the interface between the filter 40 and filler charge 30, thus further insuring that the filter 40 does not separate from the filler charge 30 during use.

Figure 7:
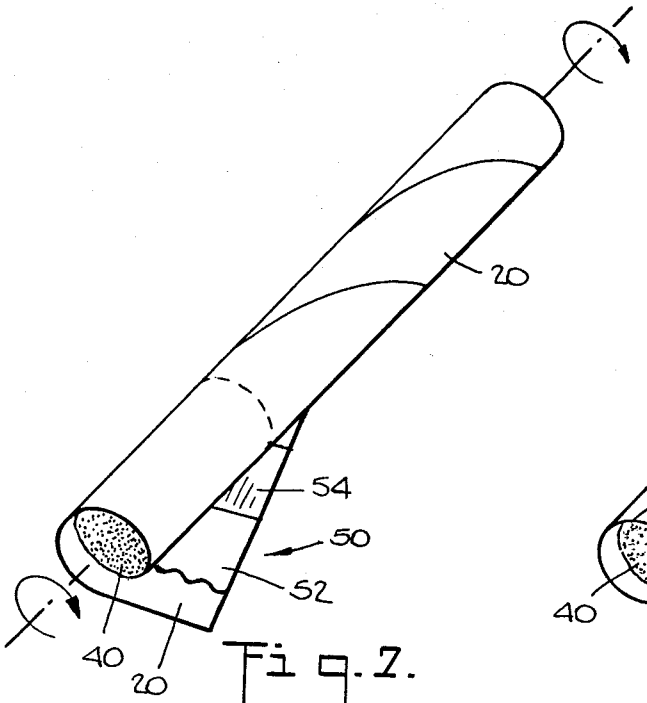
FIGS. 5–7 are perspective views sequentially but schematically illustrating a method of rolling one embodiment of the cigar of the present invention wherein the filter, filler charge, binder, and reinforcement strip are rolled in such a manner as to produce a filtered large cigar in which the reinforcement strip is circumferentially wrapped under and bonded to the binder over the point of intersection between the filter and filler charge.
Figure 6:
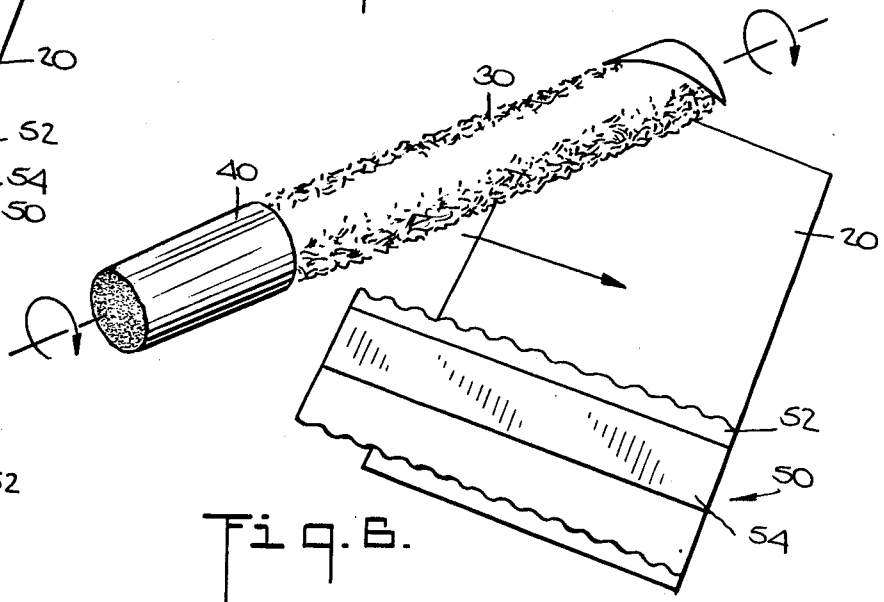
Figure 5:
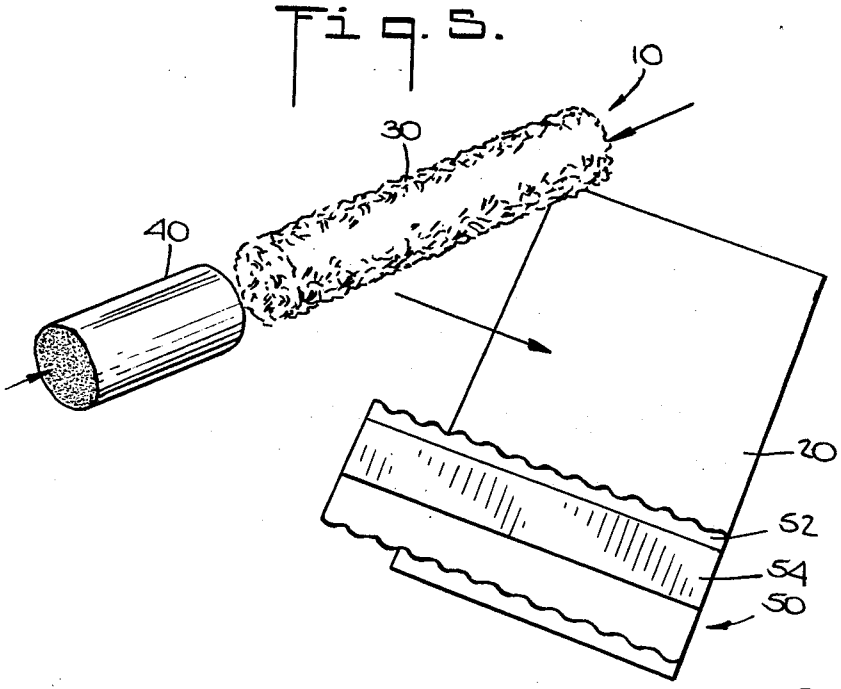

Although the filtered large cigar of the present invention may be manufactured in a variety of ways including, for example, hand rolling techniques, a preferred method for forming the filtered large cigar of the embodiment of FIG. 1 is shown in FIGS. 3–8. In this embodiment, reinforcement strip 50, as shown in FIGS. 3 and 4, is initially formed by adhesively bonding the foil 54 to the reinforcing tape 52 and then, as shown in FIGS. 5–7, after joinder of the filter 40 and tobacco filler charge 30, the binder 20 and reinforcement strip 50 are simultaneously wrapped about the filter 40 and filler charge 30 as shown in FIG. 7. This causes the binder to become spirally wrapped about the filter 40 and filler charge 30 with the reinforcement strip 50 circumferentially wrapped under the binder 20 and positioned directly over the interface between the filter 40 and filler charge 30.

Figure 8:
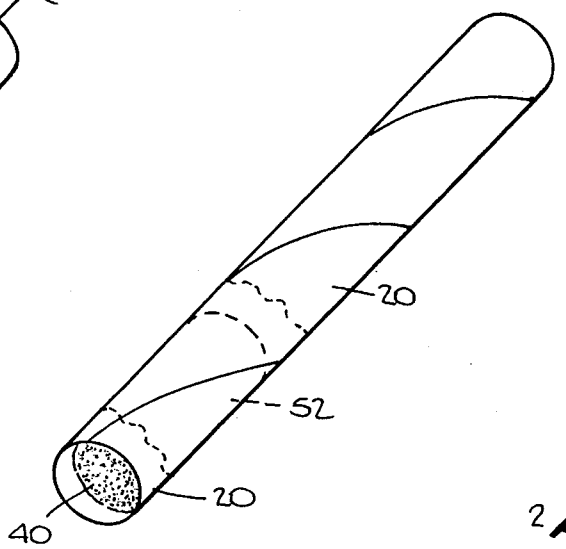
FIG. 8 is a perspective view of the filtered large cigar of FIG. 1 prior to crimping and the application of an external wrapper.

The resultant cigar bunch shown in FIG. 8 is then cut and crimped in subsequent operations (not shown) to form the crimped but unwrapped cigar 10 of FIG. 1. A conventional cigar wrapper may then be conventionally applied to produce what would then have the outward appearance of an unfiltered large cigar. Conventional cigar wrappers which may be used include natural tobacco leaf wrappers and reconstituted or manufactured wrappers including wrappers which have been decorated to simulate natural tobacco leaves by the embossing of a vein-like pattern thereon.

Similarly, the cigar of the embodiment of FIGS. 9–10 may be manufactured using essentially the same method described in FIGS. 5–7, however, the relative positioning of the reinforcement strip 50' and binder 20' prior to wrapping are reversed resulting in the reinforcement strip 50' being wrapped over the binder 20'.

Having thus described the invention with particular reference to the preferred forms thereof, it will be obvious that various changes and modifications may be made therein without departing from the spirit and scope of the invention as defined by the appended claims.

What is claimed is:

1. An improved filter cigar of the type wherein a preformed, cylindrically shaped filter is tightly mated with a tobacco filler charge both integrally wrapped in sheets of cigar binder and cigar wrapper material, wherein the improvement comprises:

reinforcement means for preventing separation between said filter and said filler charge, said reinforcement means comprising a strip of high wet strength material circumferentially wrapped over the interface between the filter and filler charge and directly bonded to the binder on both sides of said interface; and flame extinguishment means to extinguish the flame of said cigar prior to ignition of said filter, said flame extinguishment means comprising a strip of nonflammable material circumferentially wrapped over said interface and directly bonded to said reinforcement strip.

2. The filter cigar of claim 1 wherein said reinforcement means are circumferentially wrapped over and bonded to said binder material.

3. The filter cigar of claim 1 wherein said reinforcement means are circumferentially wrapped under and bonded to said binder material.

4. The filter cigar of claim 1 wherein said nonflammable material is a metallic foil.

* * * * *